United States Patent [19]

Klier et al.

[11] 4,181,079

[45] Jan. 1, 1980

[54] HOLLOW CHARGE AMMUNITION CONSTRUCTION

[75] Inventors: Hermann Klier, Waidhofen; Gerd Kellner, Aresing; Johann Mayer, Rettenbach, all of Fed. Rep. of Germany

[73] Assignee: Messerschmitt-Bolkow-Blohm GmbH, Fed. Rep. of Germany

[21] Appl. No.: 840,958

[22] Filed: Oct. 11, 1977

[30] Foreign Application Priority Data

Oct. 8, 1976 [DE] Fed. Rep. of Germany ..... 2645419

[51] Int. Cl.[2] ..... F42B 13/10

[52] U.S. Cl. ..... 102/56 SC; 102/7.2; 102/69

[58] Field of Search ..... 102/24 HC, 56 SC

[56] References Cited

U.S. PATENT DOCUMENTS

| | | | |
|---|---|---|---|
| 2,667,836 | 2/1954 | Church et al. | 175/4.6 |
| 2,960,036 | 11/1960 | Curl et al. | 102/56 SC |
| 3,053,488 | 9/1962 | Cox, Jr. | 60/269 |
| 3,855,933 | 12/1974 | Messineo | 102/56 SC |

FOREIGN PATENT DOCUMENTS

| | | | |
|---|---|---|---|
| 2205074 | 3/1977 | Fed. Rep. of Germany | 102/56 SC |
| 1520577 | 3/1968 | France | 102/24 HC |
| 2071271 | 9/1971 | France | 102/8 |

*Primary Examiner*—Verlin R. Pendegrass
*Attorney, Agent, or Firm*—McGlew and Tuttle

[57] ABSTRACT

A hollow charge ammunition particularly for dispersive weapons comprises a hollow charge having a forward end face with a recess and with a barb-forming liner in the recess overlying the end face. A folded member, such as a bellows-like structure is disposed in the recess and extends across the end face and it is unfoldable into an aerodynamically-formed stable structure extending outwardly forwardly of the recess. The device includes means such as a compressed gas for unfolding the member into the outwardly extending position at which it forms an aerodynamic surface.

9 Claims, 3 Drawing Figures

HOLLOW CHARGE AMMUNITION CONSTRUCTION

BACKGROUND OF THE INVENTION

1. Field of the Invention

The invention relates, in general, to hollow charge ammunition and, in particular, to a new and useful explosive charge for dispersive weapons, which on one end face has a recess for a barb-forming lining or projectile-forming covering.

2. Description of the Prior Art

Among the known designs of ammunition, those are very numerous which present, at what in flight direction is the forward end face of the explosive charge, a barb-forming lining or projectile-forming covering, and before it, to attain great depth performances, a spacer of constant length in the form of an ogival hood. Disadvantageous in such a contruction is the great space requirement of such spacers, especially when it is important to accommodate a maximum quantity of ammunition.

The situation is different when using spacers consisting of extendible telescoping tubes. This, however, involves considerable additional expense for the mechanical release and extending of the telescoping tubes, which for reasons of compactness are initially pushed one into the other. Disadvantageous in this case is further that spacers of the kind in question are, from the aerodynamic aspect, inferior to those in the form of ogival hoods and not infrequently noticeably impair, due to their smaller free cross-sections, the depth penetration performance of the hollow charge barb or explosion-shaped projectile passing through them in case of detonation.

When ammunition designs of this kind are intended to be scattered several at a time from rocket warheads, aircraft containers or the like and thereafter to fall to the ground, use is often made of rigid slit tail contructions protruding over the explosive charge, namely for the purpose of directional stabilization of the scattered pieces of ammunition in vertical position. With the slit tail, however, the structural length of the tail increases accordingly, with analogous effect on the accommodation of maximum quantities of ammuntion in a limited space.

SUMMARY OF THE INVENTION

The present invention provides hollow charge ammunition which is versatile in use, combining a simple compact construction with high reliability and excellent effectiveness.

According to the invention, the lined or covered front end charge recess has on the side of the lining or covering base a gas-impermeable closure in the form of a coaxial cuffed-in bellows with associated compressed gas source for the cuffing out and inflation of the bellows to a form-stable structure of aerodynamically appropriate external contour.

The measure taken according to the invention can be realized without any appreciable cost. Where this is done, conventional spacers and direction stabilizers of the above-described rigid construction becomes superfluous, thereby permitting a reduction of the overall length of the ammunition important, among other things, for the storage and the charge density of dispersive weapon containers, and this without having to accept loss in depth performance of the hollow charge barb or explosion-shaped projectile. It is possible to do without spacers and direction stabilizers because the form-stable structure consisting of the bellows cuffed out and inflated with compressed gas from the source provided therefor is itself readily able to assume their functions. It depends on the purpose for which it is intended whether the lined or covered charge recess has the cuffed-in bellows arranged on the forward or rearward explosive charge face seen in a flight direction.

Both variants of arrangement readily leave open the possibility to provide, by the different shape of the bellows cuffed into the lined or covered front end charge recess for reduction of the packing length, that after the cuffing out and inflation of the bellows to a form-stable structure, the bellows has an external contour especially favorable aerodynamically for the respective purpose. When the bellows is used as a spacer, it is preferably an ogival one.

In the last-mentioned application, one advantage is that the compressed gas in the cuffed-out and inflated bellows serves practically as shock absorber for the explosive charge behind it. This causes the stresses of the explosive charge upon impingement of the ammunition on the respective target to be much lower than when using conventional rigid spacer structures.

As another advantage, with the structure of the bellows cuffed out and inflated there is no difficulty whatsoever in optionally adapting its mechanical strength within wide limits to the prevailing velocity conditions and to the stresses resulting therefrom. This, in fact, can be done inexpensively by pressure variation of the gas used for the cuffing out and inflation of the bellows.

The cuffing out and inflation of the bellows to a form-stable structure, which occurs when the ammunition is used, as in the example in dispersive weapon systems following the ejection of the ammunition from the dispersive weapon container, is particularly simple and without any complication if, in the flow path of the compressed gas from the compressed gas source in the form of a solid-gas generator, a compressed air cartridge is connected to the bellows along with a safety valve and a force-exerting element for opening a straightway valve and are arranged one behind the other.

To rule out from the start any damage to the bellows by excessive gas pressures in the interior of the bellows, it is advisable to install an overpressure check valve in the flow path of the compressed gas between the aforesaid straightway valve and the bellows. Such a valve, being adjustable, is suitable at the same time as a means for varying the internal pressure of the bellows.

Accordingly, it is an object of the invention to provide a hollow charge ammunition which comprises a hollow charge having a forward end face for the recess, a barb-forming liner in the recess overlying the end face and a folded member disposed in the recess which extends across the end face and is unfoldable into an aerodynamically formed stable structure extending outwardly forwardly of the recess and preferably with means for effecting the unfolding including a compressed gas for driving a central strike contact portion forwardly ahead of the hollow charge into an unfolded condition.

A further object of the invention is to provide a hollow charge ammunition which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

GENERAL DESCRIPTION OF THE PREFERRED EMBODIMENTS

Figure 1:
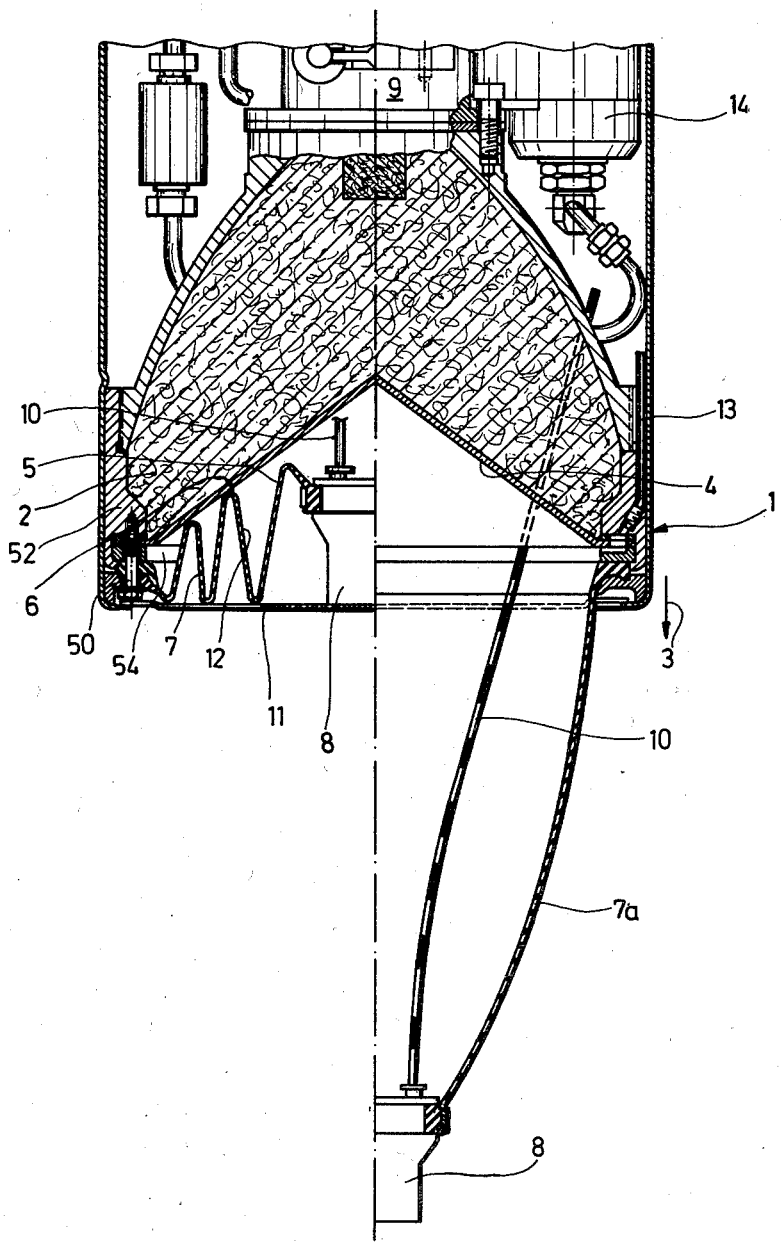
FIG. 1 is an axial sectional view of a hollow charge ammunition constructed in accordance with the invention.
Figure 2:
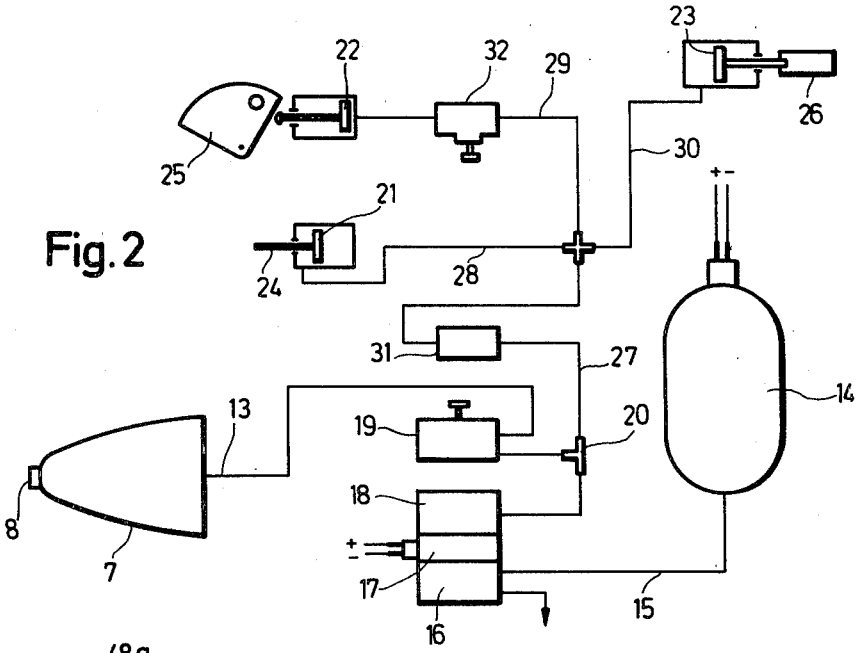
FIG. 2 is a bock diagram indicating the operative elements of the hollow charge shown in FIG. 1.

Referring to the drawings in particular, the invention embodied therein in FIG. 1 comprises a hollow charge ammunition 1 which, for example, may be a missile which travels in a flight direction as indicated by the arrow 3. The hollow charge ammunition includes an explosive charge 2 which has a forward end face with a recess 5 of funnel-shape configuration which is covered by a barb-forming liner 6 which extends across the end face. Because of the favorable ratio of structural length to diameter, the hollow charge ammunition 1 is excellently suitably for dispersive weapon systems among other systems.

In accordance with the invention, a folded member or aerodynamically formed stable structure 7 is disposed in the recess 5 in a folded condition. In the folded condition, the folded member 7 comprises a bellows-like structure which is connected at its periphery such as by a securing bolt 50 to a ring member 52 which surrounds the periphery of the hollow charge adjacent the forward end. The folded member 7 is clamped together with a ring structure 54 by the bolts 50 and its central periphery has an opening which is engaged around a strike contact member 8. The strike contact member in the folded position lies within the recess 5, and it is provided with connecting lines 10 extending to a securable electric ignition device 9. Until a given point in time during the flight of the ammunition charge 1, the folded member 7 with the strike contact 8 is prevented from issuing from the charge recess 5 by a bursting membrane or cover 11 which covers the forward end of the hollow charge 1.

Means are provided for unfolding the folded member 7 which, in the present embodiment, comprises means for supplying a pressurized gas or compressed gas from a gas generator 14 through a channel 13 to the space behind the unfolded member in the recess 5 so as to inflate the member and force it to an unfolded position, as indicated to the right hand of FIG. 1. When this occurs, the membrane 11 will burst and the unfolded member 7 becomes an erected member or an aerodynamically formed stable structure 7*a* which extends outwardly from the recess in a forward direction in respect to the flight direction 3. The formed stable structure 7*a* is of ogival external contour and it forms a function of a spacer.

If the gas generator 14 is appropriately laid out for high performance, it becomes possible to make use of some of the generated compressed gas for secondary functions. In the present example, the derivation of the compressed gas portion is at a point marked 20 between the straightway valve 18 and the overpressure check valve 19. It serves to actuate pistons 21 to 23, by means of which movable elements 24 to 26 of a safety device associated with the ignition device can be moved from the safe to the sharp position. The movable elements of the safety device are, for example, a pull pin 24, a rotor 25 and a slide 26, piston 21 engaging at the pull pin 24, piston 22 at the rotor 25, and piston 23 at the slide 26. The lines leading from the branch point 20 to the piston 21 to 23 are designated 27 to 30. In line 27, a check valve 31 is disposed. Line 29 has a throttle at point 32.

Figure 3:
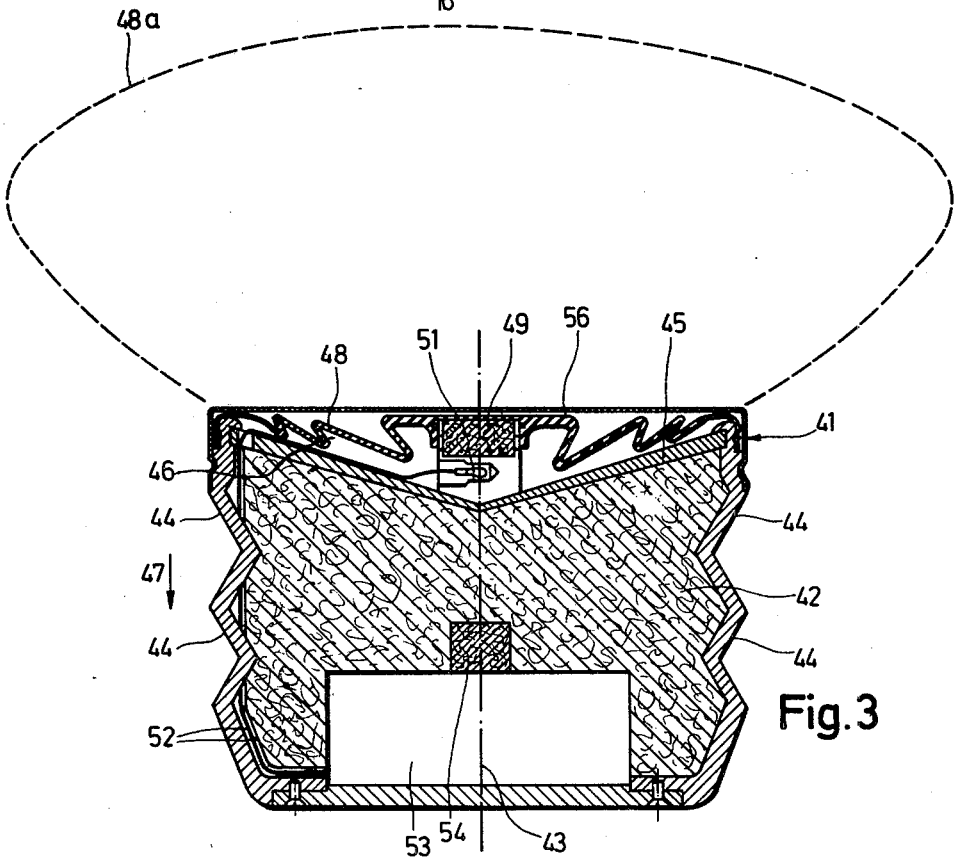
FIG. 3 is a view similar to FIG. 1 of another embodiment of the invention.

FIG. 3 illustrates a mine 41 intended to be dispersed in the intended target area from rocket warheads or the like and thereafter to fall to the ground direction-stabilizied. Its explosive charge is marked 42. In, for example, two arrangement planes normal to the longitudinal axis 43 of the charge, it has a plurality of projectile-forming coverings 44 uniformly distributed over the charge circumference. Such a covering or hollow charge liner 45 is present also in a charge recess 46 on the rear face of the explosive charge 42 in respect to a falling direction designated by an arrow 47. Into the charge recess 46 which is closed by a removable cover 56, there is fitted a bellows 48, a gas generator 49 is secured to the inside of the bellows for cuffing out and inflating the bellows after completed mine scattering. The cuffing out and inflating of the bellows results in a form-stable structure 48*a*, which due to its external contour shown in broken lines is excellently suitable for position stabilization and deceleration of the mine 41 during its fall. The gas cartridge 49 is ignited by an electric ignition pellet 51. The pellet 51 is in operative connection via wires 52 with the electrical ignition system 53 responsible for initiating the mine explosive charge 42. The ignition system includes a primer 54.

While specific embodiments of the invention have been shown and described in detail to illustrate the application of the principles of the invention, it will be understood that the invention may be embodied otherwise without departing from such principles.

What is claimed is:

1. A hollow charge ammunition which is adapted to move in a flight direction, in particular for dispersive weapons, comprising a hollow charge having a forward end face facing in the flight direction with a recess therein, a barb-forming liner in said recess overlying said end face, a folded member disposed in said recess extending across said end face and being unfoldable into an aerodynamically formed stable structure extending outwardly from said recess and means for unfolding said folded member.

2. A hollow charge, according to claim 1 wherein said folded member is gas impermeable and means for applying a compressed gas into the space between said liner and said folded member comprising said means for unfolding said folded member.

3. A hollow charge ammunition, in particular for dispersive weapons, comprising a hollow charge having a forward end face with a recess therein, a barb-forming liner in said recess overlying said end face, a folded member disposed in said recess extending across said end face and being unfoldable into an aerodynamically formed stable structure extending outwardly from said recess and means for unfolding said folded member, said folded member comprising a bellows-like structure and including a central strike contact and ignition means connected to said strike contact for igniting said strike contact.

4. A hollow charge ammunition, in particular for dispersive weapons, comprising a hollow charge having a forward end face with a recess therein, a barb-forming liner in said recess overlying said end face, a folded member disposed in said recess extending across aid end face and being unfoldable into an aerodynamically formed stable structure extending outwardly from said recess, and means for unfolding said folded member, said folded member comprising a bellows-like structure having a periphery secured around the periphery of said liner and said hollow charge, said folded member forming a gas-tight enclosure between said member and said liner, and means for directing a pressure gas into the space between said member and said liner to cause the outward unfolding of the folded member, said folded member in an unfolded state having an ogival external contour.

5. A hollow charge ammunition, in particular for dispersive missile weapons which move in a flight direction which must be stabilized by a direction stabilizer comprising a hollow charge, having at least one end face with a recess, a barb-forming liner in said recess overlying said end face, a folded member disposed in said recess extending across said end face being expandable into an aerodynamically formed stable structure extending outwardly away from said recess, means for unfolding said folded member comprising a solid gas generator and valve means connected between said generator and the space between said unfolded member and said liner including a safety valve, a force exerting element, a straight way valve, said force exerting element being connected to said straight way valve to open said straight valve being arranged in series.

6. A hollow charge ammunition, in particular for dispersive missile weapons which move in a flight direction which must be stabilized by a direction stabilizer comprising a hollow charge, having at least one end face with a recess, a barb-forming liner in said recess overlying said end face, a folded member disposed in said recess extending across said end face being expandable into an aerodynamically formed stable structure extending outwardly away from said recess, a compressed gas generator, means disposed between said compressed gas generator and the space between said unfolded member and said liner for varying the pressure of gas delivered into said space.

7. A hollow charge, according to claim 6, including an adjustable overpressure check valve disposed in the flow path of the compressed gas between said straight-way valve and said folded member.

8. A hollow charge ammunition, in particular for dispersive missile weapons which move in a flight direction which must be stabilized by a direction stabilizer comprising a hollow charge, having a forward end facing in a flight direction and at least one opposite rear end facing away from the flight direction with a recess, a barb-forming liner in said recess overlying said forward end face, a folded member disposed in said recess extending across said end face being expandable into an aerodynamically formed stable structure extending outwardy away from said recess in the flight direction.

9. A hollow charge ammunition, according to claim 8, wherein said end face comprises a rear end face in respect to the flight direction of said hollow charge ammunition, said folded member when unfolded forming the direction stabilizer having braking property.

* * * * *